United States Patent [19]

Schuss et al.

[11] Patent Number: 4,924,236

[45] Date of Patent: May 8, 1990

[54] PATCH RADIATOR ELEMENT WITH MICROSTRIP BALIAN CIRCUIT PROVIDING DOUBLE-TUNED IMPEDANCE MATCHING

[75] Inventors: Jack J. Schuss, Sharon; Jerome D. Hanfling, Framingham, both of Mass.

[73] Assignee: Raytheon Company, Lexington, Mass.

[21] Appl. No.: 116,192

[22] Filed: Nov. 3, 1987

[51] Int. Cl.[5] ..... H01Q 1/38

[52] U.S. Cl. ..... 343/700 MS; 343/830; 343/859

[58] Field of Search ..... 343/700 MS, 829, 830, 343/846, 859, 862; 333/26, 33, 35

[56] References Cited

U.S. PATENT DOCUMENTS

| | | | |
|---|---|---|---|
| 3,757,342 | 9/1973 | Jasik et al. | 343/700 MS |
| 4,042,935 | 8/1977 | Ajioka et al. | 343/795 |
| 4,089,003 | 5/1978 | Conroy | 343/700 MS |
| 4,320,402 | 3/1982 | Bowen | 343/700 MS |
| 4,414,550 | 11/1983 | Tresselt | 343/700 MS |
| 4,477,813 | 10/1984 | Weiss | 343/700 MS |
| 4,575,725 | 3/1986 | Tresselt | 343/700 MS |
| 4,660,048 | 4/1987 | Doyle | 343/830 |
| 4,783,661 | 11/1988 | Smith | 343/700 MS |

FOREIGN PATENT DOCUMENTS

| | | | |
|---|---|---|---|
| 58704 | 4/1985 | Japan | 343/824 |
| 8103398 | 11/1981 | PCT Int'l Appl. | 343/700 MS |
| 2152757 | 8/1985 | United Kingdom | 343/700 MS |

OTHER PUBLICATIONS

Carver et al., Microstrip Antenna Technology, IEEE Trans. on Ant's and Prop., vol. AP-29, No. 1, Jan. 1981.

*Primary Examiner*—Rolf Hille
*Assistant Examiner*—Michael C. Wimer
*Attorney, Agent, or Firm*—Christopher L. Maginniss; Richard M. Sharkansky

[57] ABSTRACT

A low-profile patch radiator for use in an array antenna has a multilayer structure which includes a double-tuned impedance matching network and balun and a coaxial feed for linear polarization of the radiated waves. A second embodiment further includes a second double-tuned impedance matching network and balun and a second coaxial feed for dual polarization operation. The matching networks/baluns, which comprise microstrip circuits on Duroid substrates, increase the frequency bandwidth of the patch radiator.

21 Claims, 10 Drawing Sheets

PATCH RADIATOR ELEMENT WITH MICROSTRIP BALIAN CIRCUIT PROVIDING DOUBLE-TUNED IMPEDANCE MATCHING

BACKGROUND OF THE INVENTION

The present invention relates generally to antenna systems and, more particularly, to a compact, low-profile patch element suitable for use in airborne or spaceborne phased array antennas.

In the prior art, phased array antennas are favored in many applications, particularly for their versatility. They respond almost instantaneously to beamsteering changes, and they are well-suited for integration into adaptive beamforming systems. A major drawback to the use of phased array antenna systems is their high cost. A typical array may include hundreds or thousands of elements, and each element, with its associated feed and phase shifting circuitry, may cost in the order of thousands of dollars.

One way of reducing the cost per element in a phased array may be through the use of integrated circuit technology, thereby producing a monolithic-like phased array. At the present time, a patch element appears to be a promising candidate for such monolithic implementation.

A patch radiator consists of a conductive plate, or patch, separated from a ground plane by a dielectric medium. When an Rf current is conducted within the cavity formed between the patch and its ground plane, an electric field is excited between the two conductive surfaces. It is the fringe field, between the outer edges of the patch and the ground plane, that launches the usable electromagnetic waves into free space. A low-profile patch radiator, i.e., one in which the thichness of the dielectric medium is typically less than a tenth-wavelength, generates an image patch in a plane under the ground plane which produces a current tending to cancel out the current in the real patch and thereby prevent effective radiation. Patch radiators can, however, be made to operate in a narrow band near their resonant frequency by exciting a high Q, cavity-like mode that effectively couples to the fringe field.

Patch elements are advantageous in phased arrays because they are compact, they can be integrated into a microwave array very conveniently, they support a variety of feed configurations, and they are capable of generating circular polarization. They also have the advantage of cost effective printed circuit manufacture of large arrays of elements. However, because of their need to operate at or very near their resonant frequency, patch elements suffer from the serious disadvantage of narrow bandwidth, typically two to five percent for elements on thin substrates.

The bandwidth of a patch radiator may be increased by the use of a thicker dielectric substrate. However, this practice also reduces the maximum scan angle of the radiator due to surface wave generation. Use of a thicker substrate also adds weight to the radiator, which is a significant problem in airborne applications.

The bandwidth may also be increased by the use of an external matching network for the radiator. In most applications, however, there is insufficient room available for the placement of such a circuit. Dual polarization is especially difficult to achieve in the compact volume of a patch radiator because of the need for a second matching network.

SUMMARY OF THE INVENTION

It is therefore a primary object of the present invention to provide a compact patch radiator allowing wide frequency bandwidth and wide scan angles, and capable of operating in a dual polarized mode.

This object is attained generally by integrating matching microstrip networks into the patch radiator assembly and using the patch element and ground plane to mount the matching networks; by selecting a patch radiator thickness and matching networks to achieve the performance objectives; and by including as many as four probes so as to achieve full balanced, dual polarized operation.

In accordance with the principles of the present invention, an apparatus is disclosed for use in the radiator of a phased array antenna which includes an electrically-conductive patch element separated from a ground plane element to form a cavity therebetween, and which further includes coupling means for receiving an input signal thereto. The disclosed apparatus excites an electric field in the cavity. It comprises a microstrip circuit coupled to the coupling means for providing double-tuned impedance matching between the coupling means and the patch element. The microstrip circuit includes trace wiring positioned intermediate the patch element and the ground plane element, the patch element functioning as a ground plane for the microstrip circuit. The apparatus also includes a conductive probe disposed between the microstrip circuit trace wiring and the ground plane element for conducting current in the cavity. Current flow within the cavity excites an electric field between the patch element and the ground plant element. Fringe fields between the edges of the patch element and the ground plane element radiate electromagnetic waves into free space.

In accordance with another feature of the present invention providing enhanced polarization purity of the radiated waves, the above-mentioned apparatus further comprises a second conductive probe disposed between the microstrip circuit trace wiring and the ground plane element for conducting current in the cavity formed between the patch element and the ground plane element, and wherein the microstrip circuit further includes a balun responsive to an input signal applied at the coupling means for providing signals in phased-apart relationship respectively at the first-mentioned and second probes.

In accordance with still another feature of the present invention providing selectable first and second polarizations of the radiated waves, the above-mentioned antenna further includes second coupling means for receiving a second input signal thereto. The above-mentioned apparatus further comprises a second microstrip circuit having its trace wiring positioned intermediate the ground plane element and the first-mentioned microstrip circuit trace wiring, the ground plane element functioning as ground plane for the second microstrip circuit. The second microstrip circuit trace wiring is coupled to the second coupling means for providing double-tuned impedance matching between the second coupling means and the patch element. The apparatus further comprises third and fourth conductive probes disposed between the second microstrip circuit trace wiring and the patch element for conducting current in the cavity formed between the patch element and the ground plane element. The second microstrip circuit further includes a second balun responsive to an input signal applied at the second coupling means for providing signals in phased-apart relationship respectively at the third and fourth probes. The probes are relatively positioned such that the plane including the first and second probes is not parallel with the plane including the third and fourth probes.

Other features and advantages of the present invention will be more fully understood from the accompanying drawings, the detailed description of the preferred embodiments, and from the appended claims.

DETAILED DESCRIPTION OF THE PREFERRED EMBODIMENTS

Figure 1:
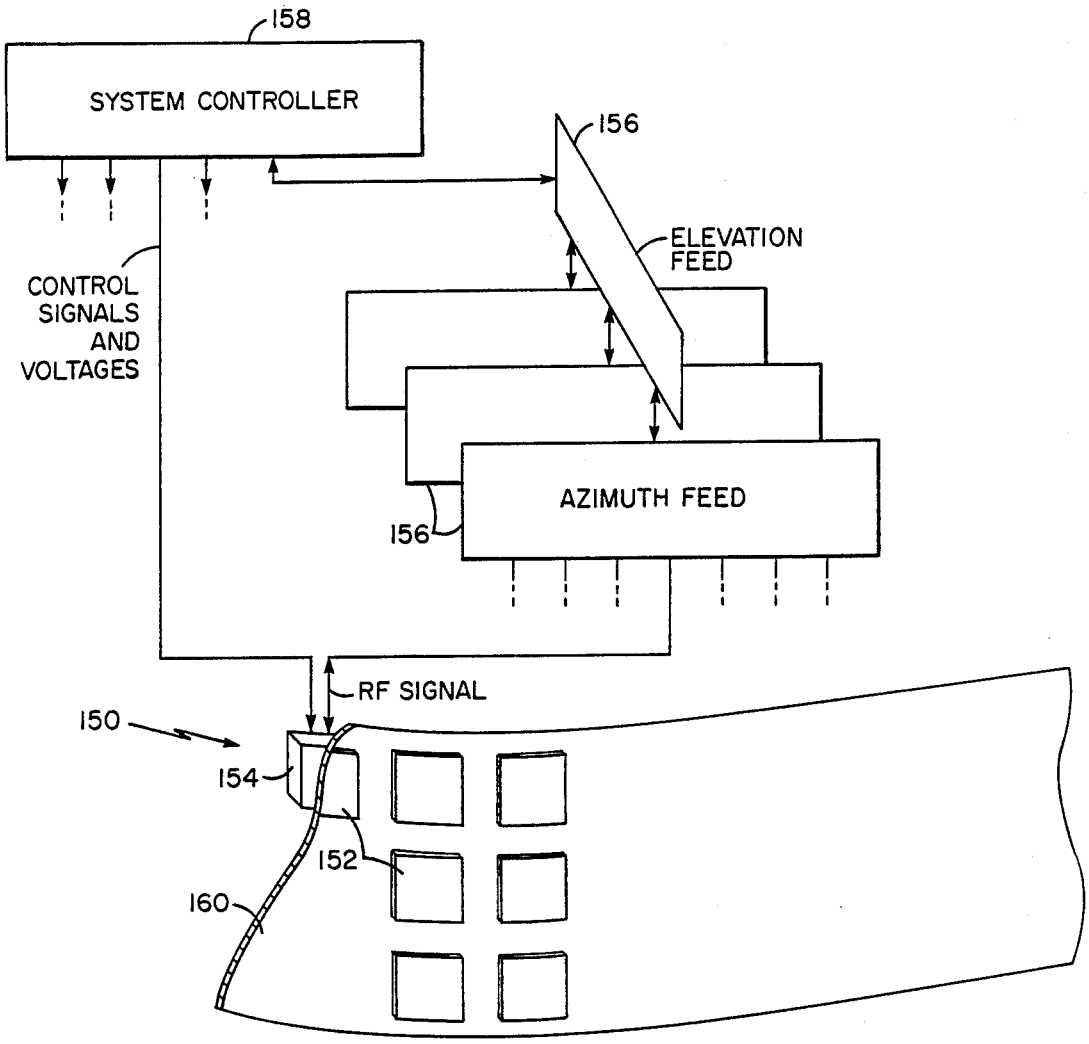
FIG. 1 is a simplified sketch of a phased array antenna including a multiplicity of radiators.

Referring initially to FIG. 1, it may be seen that a phased array antenna 150 according to the present invention includes a plurality of patch radiators 152 mounted on a surface 160, which surface 160 may be the curved outer surface of the skin of an aircraft. Each patch radiator 152 is fed by a corresponding transmit/-receive (T/R) module 154 attached to the inner side opposite surface 160. T/R modules 154 are driven by an RF feed network of RF power dividers 156, which provide RF signals to each of the T/R modules 154; phase information is supplied to each T/R module 154 through the system controller 158. System controller 158 originates the RF feed signals to power dividers 156, as well as control signals and voltages to the plurality of T/R modules 154.

Figure 2:
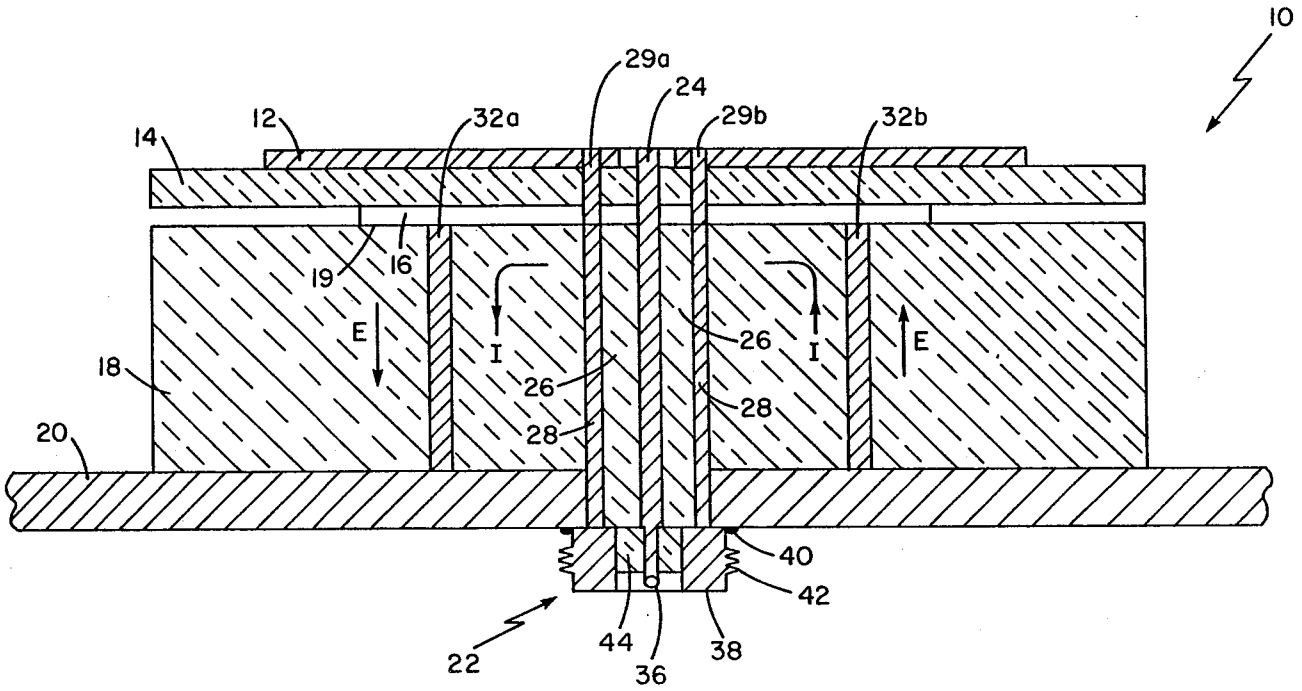
FIG. 2 is a cross-sectional view of a patch radiator according to a first embodiment of the present invention.
Figure 3:
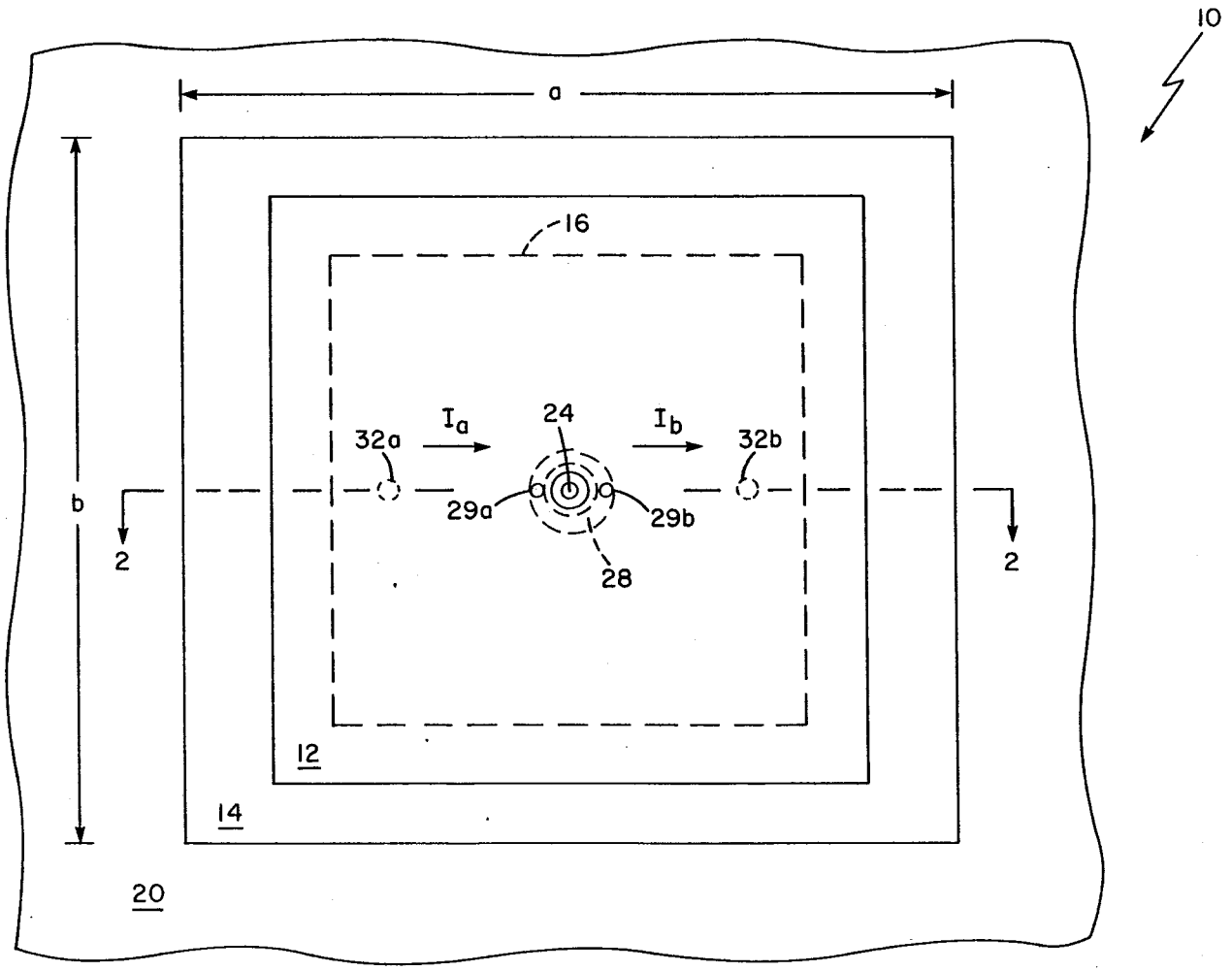
FIG. 3 is a plan view of the FIG. 2 embodiment, indicating section line 2—2 for the FIG. 2 view.

Referring now to FIG. 2, there is shown a cross-sectional view of a patch radiator 10 according to a first embodiment of the present invention. Patch radiator 10 may be of a type similar to patch radiator 152 used in phased array antenna 150 (FIG. 1). FIG. 3 illustrates a plan view of the FIG. 2 patch radiator 10. Throughout the figures, the same numerical designators will be used to identify the same or substantially identical parts.

Patch radiator 10 is a multi-layer structure including patch element 12 attached to one side of dielectric sheet 14, which has microstrip circuit trace wiring 16 etched onto its underside. Patch element 12 functions as ground plane for the microstrip circuit including trace wiring 16. This assembly is attached to dielectric sheet 18, which has bonded to its bottom surface ground plane conductor 20.

Input feed connector 22 is attached to the underside of ground plane conductor 20; a first conductor 24 of connector 22 passes through conductor 20 and dielectric sheet 18 where it makes electrical contact with trace wiring 16. Second conductor 28 of connector 22, which, illustratively, comprises a hollow cylinder, makes electrical contact with conductor 20, passes through conductor 20, dielectric sheet 18, trace wiring 16 and dielectric sheet 14 where it makes electrical contact with patch element 12 via small posts **29*a* and 29*b* extending above the cylinder of conductor 28 at positions generally symmetrical about the center of patch element 12. Conductor 24 is spaced from conductor 28 by an insulating sleeve 26**, typically made of Teflon, a registered trademark of E. I. DuPont de Nemours and Co., Wilmington, Del.

The structure of the FIGS. 2–3 embodiment of patch radiator 10 is completed by conductive probes **32*a* and 32*b* which provide a path for the flow of electrical current between trace wiring 16 and ground plane conductor 20. Probes 32*a* and 32*b* pass through dielectric sheet 18 and are substantially normal to patch element 12 and ground plane conductor 20. Probes 32*a* and 32*b* are substantially equally spaced from the center of patch element 12** and are diametrically positioned with respect to it.

In an example of the embodiment of FIG. 2, intended for use at microwave frequencies, typically at S-band, illustratively, at a center operating frequency $f_o$ having wavelength $\lambda_o$, patch element 12 is a square sheet of $\frac{1}{4}$ oz. copper, approximately 0.3 $\lambda_o$ on a side, laminated to dielectric sheet 14. Trace wiring 16 comprises copper traces etched onto dielectric sheet 14. The forms of microstrip circuit trace wiring 16, and the functions performed by it, are described in paragraphs which follow with reference to FIGS. 4, 5 and 8.

Dielectric sheet 14 is made from a low-loss composite material of medium relative dielectric constant, illustratively, a sheet of Duroid 5880 approximately 0.004 $\lambda_o$ thick, having $\epsilon_r=2.20$. Duroid is a registered trademark of Rogers Corporation. Duroid provides patch radiator 10 with a wide beamwidth in the E-plane, that is, in the direction of surface currents $I_a$ and $I_b$, as shown in FIG. 3. Its medium dielectric constant allows the surface of patch element 12 to be relatively small; in an array antenna, this permits greater separation between the patch edges, thereby minimizing destructive leaky surface waves.

Dielectric sheet 18 is also made from a low-loss composite material of medium relative dielectric constant, illustratively, Duroid 5880 having a thickness of approximately 0.05 $\lambda_o$. In a typical rectangular array including a multiplicity of patch radiators 10 of the type shown in FIGS. 2–3, dielectric sheets 14 and 18 have rectangular aspects with dimensions a and b, both of which may be substantially equal to 0.5 $\lambda_o$. Conductive ground plane 20 may be a plate of 1 oz. copper on the bottom of dielectric sheet 18, which is bonded onto a metal plate using a conductive bonding film, silver epoxy or solder. The assembly comprising patch element 12, dielectric sheet 14 and microstrip circuit trace wiring 16 is typically bonded to the assembly comprising dielectric sheet 18 and conductor 20 by a thin, heat-sensitive bonding film 19, for example, type 3M-6700, sold by Minnesota Mining & Manufacturing Company, St. Paul, Minn. The exemplary bonding film 19 has a thickness of 0.0015 inch (0.038 mm). The thickness of trace wiring 16 as illustrated in FIG. 2 is highly exaggerated; in fact, trace wiring 16 is substantially flush with the bottom surface of dielectric sheet 14. Thus, there is no noticeable gap between dielectric sheets 14 and 18 when the two assemblies are bonded.

In the present example, the total thickness between patch element 12 and ground plane conductor 20, including dielectric sheets 14 and 18, trace wiring 16 and bonding film 19, is approximately 0.06 $\lambda_o$. It is therefore seen that the patch radiator 10 disclosed herein has a low profile, having a height considerably less than one-tenth wavelength, as compared with dipole radiators which may have typical thicknesses of 0.25 $\lambda_o$.

Probes **32*a* and 32*b* are illustratively fabricated of a conductive metal such as brass, and have a diameter of approximately 0.015 $\lambda_o$. Alternatively, probes 32*a* and 32*b* may comprise two plated-through holes in dielectric sheet 18. For the patch radiator described herein by way of example, probes 32*a* and 32*b* are displaced from conductor 24 (i.e., from the central point of patch element 12**) by approximately 0.08 $\lambda_o$.

Input feed connector 22 is typically an RF coaxial connector having a center conductor female jack 36 coupled to first conductor 24. The outer shell 38 of connector 22, typicallly comprising a shielding conductor, is coupled to second conductor 28, and is also affixed to ground plane conductor 20, typically by solder 40 for physical and electrical connection thereto. Outer shell 38 is spaced from female jack 36 by an insulating dielectric sleeve 44, typically made of a polymer such as Teflon. Outer shell 38 may include spiral threads 42 for mating engagement with an appropriate RF coaxial plug (not shown).

Figure 4:
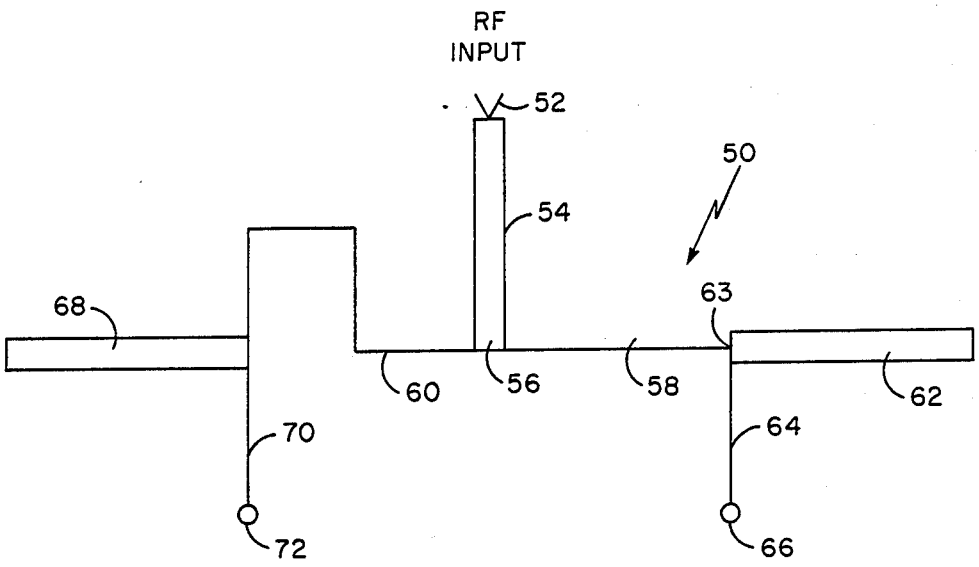
FIG. 4 is a schematic diagram of a balun/matching circuit of the FIG. 2 embodiment.

Referring to FIG. 4, there is shown a schematic representation of the microstrip circuit 50 (designated as trace wiring 16 in FIGS. 2–3) which functions as an impedance matching network and balun. Considering first the impedance matching function, an input RF signal is applied at port 52 at one end of section 54 from an input feed which may typically have a characteristic impedance of 50 ohms. Section 54 typically has characteristic impedance of 50 ohms, matching the input feed. End 56 of section 54 is a reactive split at which the input signal is divided into legs 58 and 60, each typically having characteristic impedance of 100 ohms. Leg 58 terminates in a stub 62, typically having characteristic impedance of 37 ohms, and a leg 64, typically having characteristic impedance of 111 ohms. The other end of leg 64 is an output port 66 to which probe **32*a* (see FIG. 2) is coupled. Similarly, leg 60 terminates in a stub 68, typically having characteristic impedance of 37 ohms, and a leg 70, typically having characteristic impedance of 111 ohms. The other end of leg 70 is an output port 72 to which probe 32*b* (see FIG. 2) is coupled. The characteristic impedance of legs 64 and 70 is selected to match the driving-point impedance of probes 32*a* and 32*b***.

Microstrip circuit 50 further includes a balun (balancing unit) function which is performed by legs 58 and 60, whose electrical lengths, at an illustrative center frequency $f_o$, differ by one-half wavelength or, more generally, by any odd multiple of half wavelengths. Thus, the phases of the RF input signal as seen at output ports 66 and 72 will differ by 180 degrees for an input signal frequency at input port 52 of $f_o$.

Leg 64 is fabricated with an electrical length of one-quarter wavelength at the illustrative frequency of $f_o$, and stub 62 is fabricated with an electrical length of approximately one-half wavelength at that frequency. Thus, the combination of leg 64 and stub 62 comprises a tuned circuit which is resonant at (or near) the center frequency of the band of the present example.

Furthermore, by selecting proper dimensions, patch element 12 (see FIG. 2) is also configured to be resonant at (or near) that frequency. Therefore, an RF signal at $f_o$ causes the circuit comprising devices 64 and 62 to resonate, resulting in substantial current flow through probe **32*a*. This current flow within the cavity formed by patch element 12 and ground plane conductor 20 excites an electric field (shown as E in FIG. 2) between these conductive plates 12 and 20. Electric field E induces current $I_a$ and $I_b$ (see FIG. 3) on the surface of patch element 12 at its resonant frequency. Because of the coupling between the resonant circuit comprising leg 64 and stub 62 and resonant patch element 12, patch radiator 10 may be considered to be a double-tuned circuit, and thus responsive to an increased range of frequencies. It is therefore seen that the patch radiator 10 as disclosed in FIGS. 2–3** provides an increased frequency bandwidth over which electromagnetic waves are radiated into free space.

In a similar manner, leg 70 is fabricated with an electrical length of one-quarter wavelength at $f_o$, and stub 68 is fabricated with an electrical length of approximately one-half wavelength at that frequency. Thus, the combination of leg 70 and stub 68 is also resonant at (or near) the center frequency of the band of the present example. Therefore, an RF signal at $f_o$ causes the circuit comprising devices 70 and 68 to resonate, resulting in substantial current flow through probe **32*b*. Because of the phase shift through leg 60 relative to leg 58, and because probes 32*a* and 32*b* are located in opposition relative to the center of patch element 12, probe 32*b* excites the currents $I_a$ and $I_b$ in phase with the excitation of probe 32*a* (see FIG. 3**). Thus, the probe excitations of currents $I_a$ and $I_b$ are additively reinforced.

The double tuning aspect of the present invention may be understood from the discussion that follows. The probe driving-point impedance at point 66 typically has a behavior near resonance over the frequency band $\Delta f$ of $$Z_p(f)=Z_R-jZ_i(f-f_o)/\Delta f+jX_L,$$

where $Z_p$ is the probe impedance, f is the frequency, $Z_R$ is the real value of the impedance near reasonance, $z_i/\Delta f$ is the derivative of the reactance at resonance, $\Delta f$ is the frequency bandwidth, and $X_L$ is the reactance at resonance. The probe impedance is transformed by quarter-wave leg 64 of characteristic impedance $Z_M$ to admittance Y at point 63, where $$Y=Z_p(f)/Z_M^2.$$

Half wavelength stub 62 has an admittance at point 63 of $$Y_{STUB}=jY_s \tan(2\pi l/\lambda),$$

where $Y_s$ is the stub characteristic admittance, l is its length and $\lambda$ is a wavelength in the stub transmission line ($\lambda=\lambda_o$ at the center frequency).

If the length l of stub 62 is set as $$l=\lambda_o/2-\Sigma$$

$$\Sigma=(X_L/Z_M^2Y_s)(\lambda_o/2\pi),$$

where $\Sigma$ is an increment of the stub length necessary to compensate for the probe reactance $X_L$ at $f_o$. Then, $$Y_s=f_oZ_i/Z_M^2\pi\Delta f$$

$$Z_M^2=Z_oZ_R,$$

and it can be shown that the probe impedance at output port 66 is matched to the characteristic impedance $Z_o$ of leg 58 over the band of frequencies $\Delta f$.

It will be noted that the patch radiator as disclosed herein will function in its intended purpose with but a single probe, for example, probe 32*a*. Nevertheless, the inclusion of a balun, a second tuned matching circuit, and probe 32*b* enhances the polarization purity of the fields radiated by the radiator.

Figure 5:
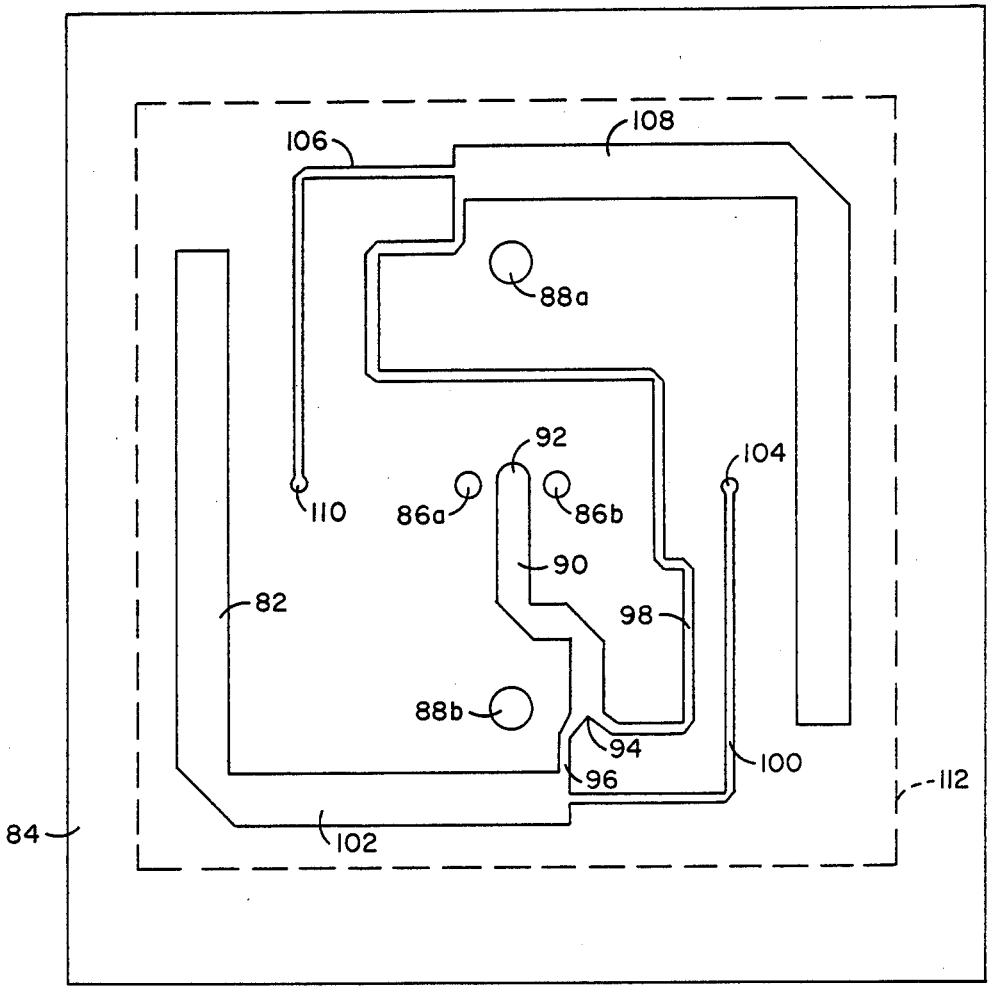
FIG. 5 is a plan view of the microstrip circuit realization of the circuit of FIG. 4.

Referring to FIG. 5, there is shown in plan view the conductive paths of a microstrip circuit realization of the circuit 50 shown in schematic form in FIG. 4. FIG. 5 illustrates trace wiring 82, typically copper, on a dielectric substrate 84, which may be dielectric sheet 14 of FIG. 2. Substrate 84 further includes apertures 86*a*, 86*b*, 88*a* and 88*b*; apertures 88*a,b* will be discussed in later paragraphs in conjunction with a further embodiment of the present invention. As such, they are not necessary elements of the embodiment shown in FIGS. 2–3.

Trace section 90 (equivalent to section 54 in FIG. 4) includes at one end pad 92, for electrical connection with conductor 24 of input feed connector 22 (see FIG. 2), and at its other end 94 includes a reactive split into trace sections 96 and 98. Trace section 96 terminates in a quarter-wavelength trace section 100 and a half-wavelength trace section 102, equivalent to leg 64 and stub 62, respectively, in the circuit of FIG. 4. Section 100 terminates in pad 104, for electrical connection with one end of probe 32*a* (see FIG. 2).

Trace section 98 terminates in a quarter-wavelength trace section 106 and a half-wavelength trace section 108, equivalent to leg 70 and stub 68, respectively, in the circuit of FIG. 4. Section 106 terminates in pad 110, for electrical connection with one end of probe 32*b* (see FIG. 2). In the circuit shown in FIG. 5, the electrical length of trace section 98 exceeds that of trace section 96 by 180 degrees.

Apertures 86*a* and 86*b* provide insulated paths for the passage of posts 29*a* and 29*b*, respectively, part of conductor 28 from input feed connector 22, to patch element 12 (see FIG. 2). Two posts 29*a,b* are used in the present example so as to provide a ground point at the center of patch element 12.

It will be noted that trace wiring 82 is folded such that it lies entirely under patch element 112 (shown as a dashed line), which acts as the ground plane of the microstrip circuit, and no significant fringe fields are generated therefrom. Positioning microstrip circuit trace wiring 82 under patch element 112 and within its area of coverage minimizes the distortion of the patch element's radiation pattern.

Figure 6:
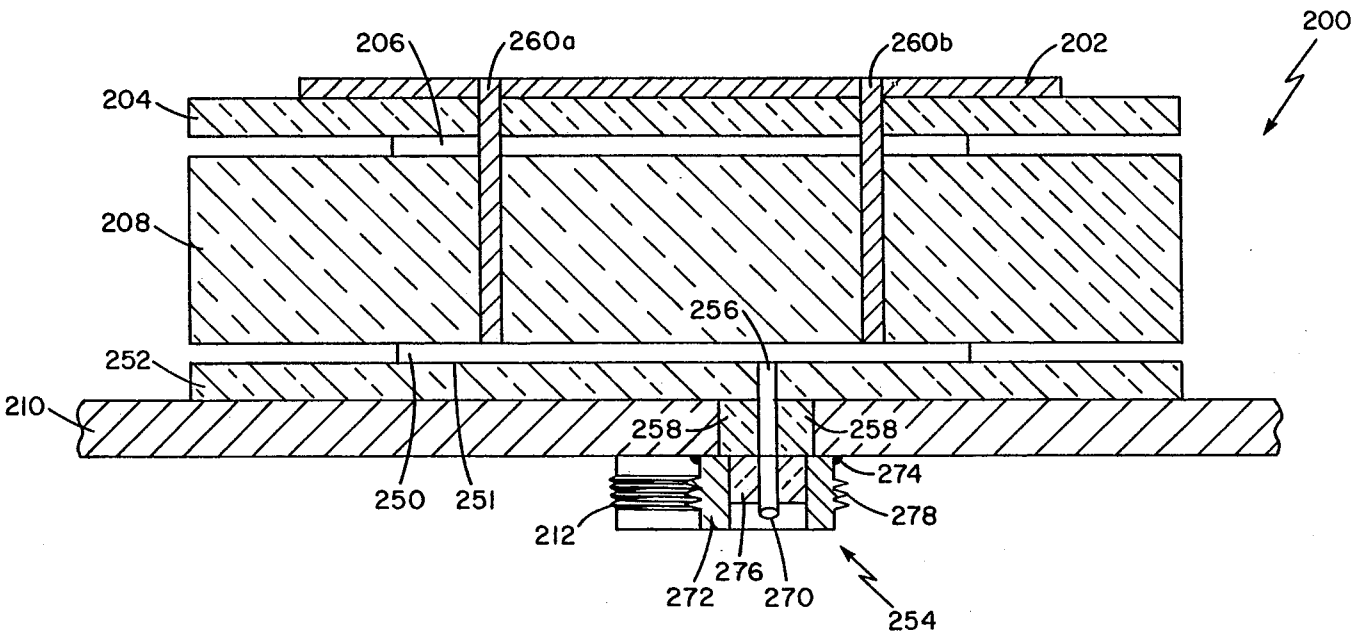
FIG. 6 is a cross-sectional view of a patch radiator according to a second embodiment of the present invention.
Figure 7:
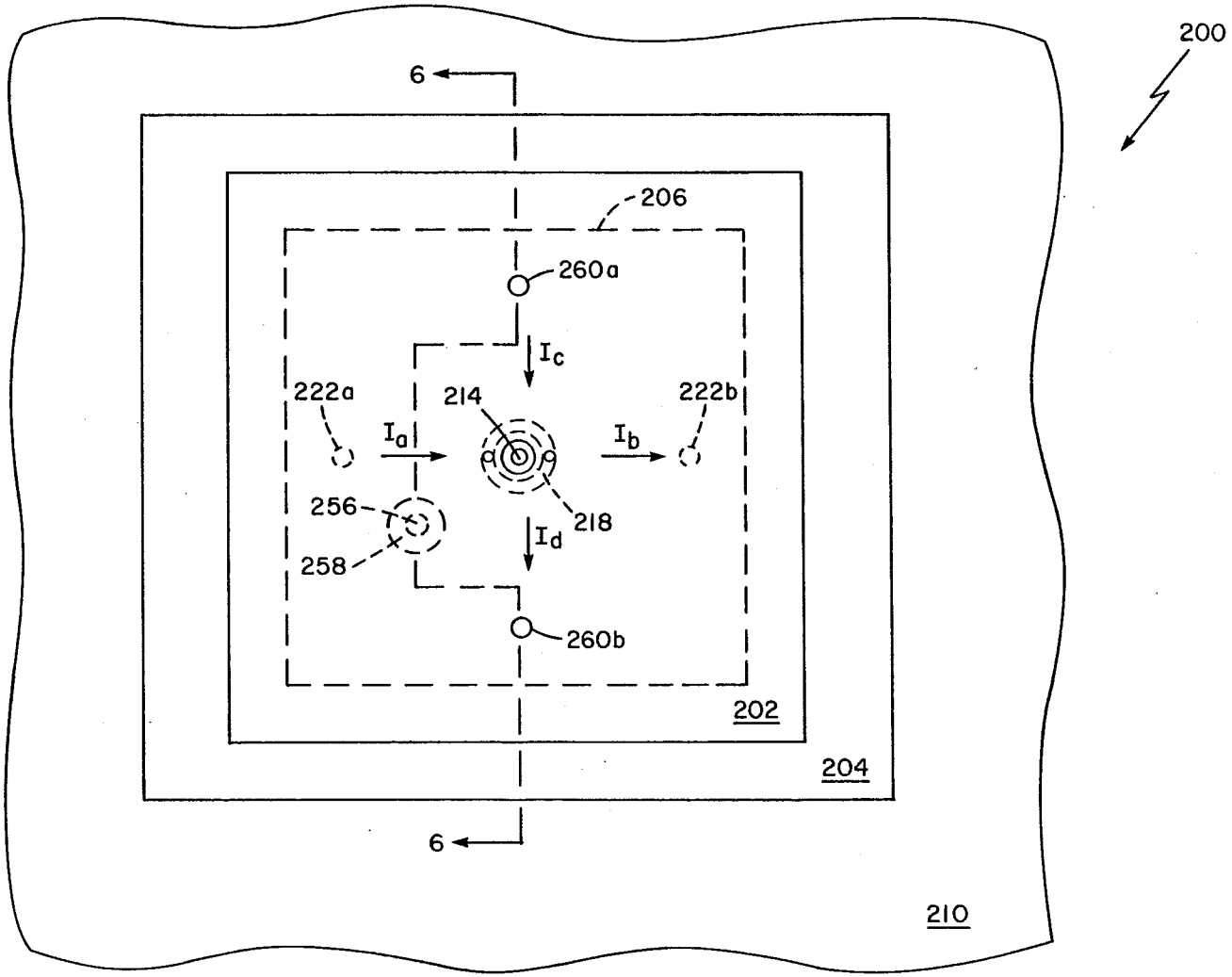
FIG. 7 is a plan view of the FIG. 6 embodiment, indicating section line 6—6 for the FIG. 6 view.

Referring to FIG. 6, there is shown a cross-sectional view of a patch radiator 200 according to a second embodiment of the present invention. FIG. 7 illustrates a plan view of the FIG. 6 patch radiator 200. The embodiment of FIGS. 6–7 includes two input feeds for selection of either of two polarizations of the electromagnetic waves launched into space.

Patch radiator 200 includes patch element 202, dielectric sheet 204, microstrip circuit trace wiring 206, dielectric sheet 208, ground plane conductor 210, input feed conductor 212 (including first conductor 214 and second conductor 218) and conductive probes 222*a* and 222*b*, which are similar to corresponding elements in the embodiment of FIGS. 2–3.

The patch radiator 200 embodiment of FIGS. 6–7 also includes a second microstrip circuit trace wiring 250 etched onto dielectric sheet 208 and a third dielectric sheet 252 interposed between ground plane conductor 210 dielectric sheet 208. Ground plane conductor 210 functions as ground plane for the microstrip circuit including trace wiring 250. Patch radiator 200 additionally includes a second input feed connector 254 attached to the underside of ground plane conductor 210. A first conductor 256 of connector 254 passes through conductor 210 and dielectric sheet 252 where it makes electrical contact with trace wiring 250. Conductor 256 is electrically isolated from ground plane conductor 210 via a dielectric sleeve 258, typically made of Teflon. Patch radiator 200 further includes conductive probes 260*a* and 260*b* which provide a path for the flow of electrical current between trace wiring 250 and patch element 202. Probes 260*a* and 260*b* pass through dielectric sheet 208, trace wiring 206 and dielectric sheet 204, where they connect to patch element 202; they are substantially normal to patch element 202 and ground plane conductor 210. Probes 260*a* and 260*b* are substantially equally spaced from the center of patch element 202 and are diametrically positioned with respect to it. Where it is desired that the electromagnetic field launched as a result of the field induced by the current flow through probes 260*a,b* be orthogonal to the field resulting from current flow through probes 222*a,b*, then the plane passing through probes 260*a,b* must be orthogonal to the plane passing through probes 222*a,b*.

In a typical example of the embodiment of FIGS. 6–7, the elements which correspond to like elements in the embodiment of FIGS. 2–3 are substantially the same material and same dimensions, with the additions and exceptions as noted below. Dielectric sheet 252 is made from a low-loss composite material to medium relative dielectric constant, illustratively, Duroid 5880 having a thickness substantially equal to sheet 204. In a manner similar to that described for the embodiment of FIGS. 2–3, the assembly including dielectric sheet 252 may be bonded to the bottom of dielectric sheet 208 and trace wiring 250 by a thin, heat-sensitive bonding film 251, and dielectric sheet 252 may be bonded to the top of ground plane conductor 210 by a conductive bonding film, silver epoxy or solder.

In this embodiment, the thickness of dielectric sheet 208 is reduced by approximately the thickness of sheet 252 in order to maintain the overall distance between patch element 202 and ground plane conductor 210 at approximately $0.06\lambda_o$; thereby maintaining the overall thickness of patch radiator 200 at considerably less than one-tenth wavelength of the input signal frequency.

Probes 260*a* and 260*b* are illustratively fabricated of a conductive metal such as brass, and have diameters of approximately $0.015\lambda_o$. For the patch radiator 200 being described herein by way of example, probes 260*a* and 260*b* are displaced from the central point of patch element 202 by approximately $0.08\lambda_o$.

Like input feed connector 212, which is equivalent to input feed connector 22 of the FIGS. 2–3 embodiment, input feed connector 254 is typically an RF coaxial connector having a center conductor female jack 270 coupled to conductor 256. The outer shell 272 of connector 254, typically comprising a shielding conductor, is the second conductor, and is affixed to ground plane conductor 210, typically by solder 274 for physical and electrical connection thereto. Outer shell 272 is spaced from center conductor 270 by an insulating dielectric sleeve 276, typically made of a polymer such as Teflon. Outer shell 272 may include spiral threads 278 for mating engagement with an appropriate RF coaxial plug (not shown).

Figure 8:
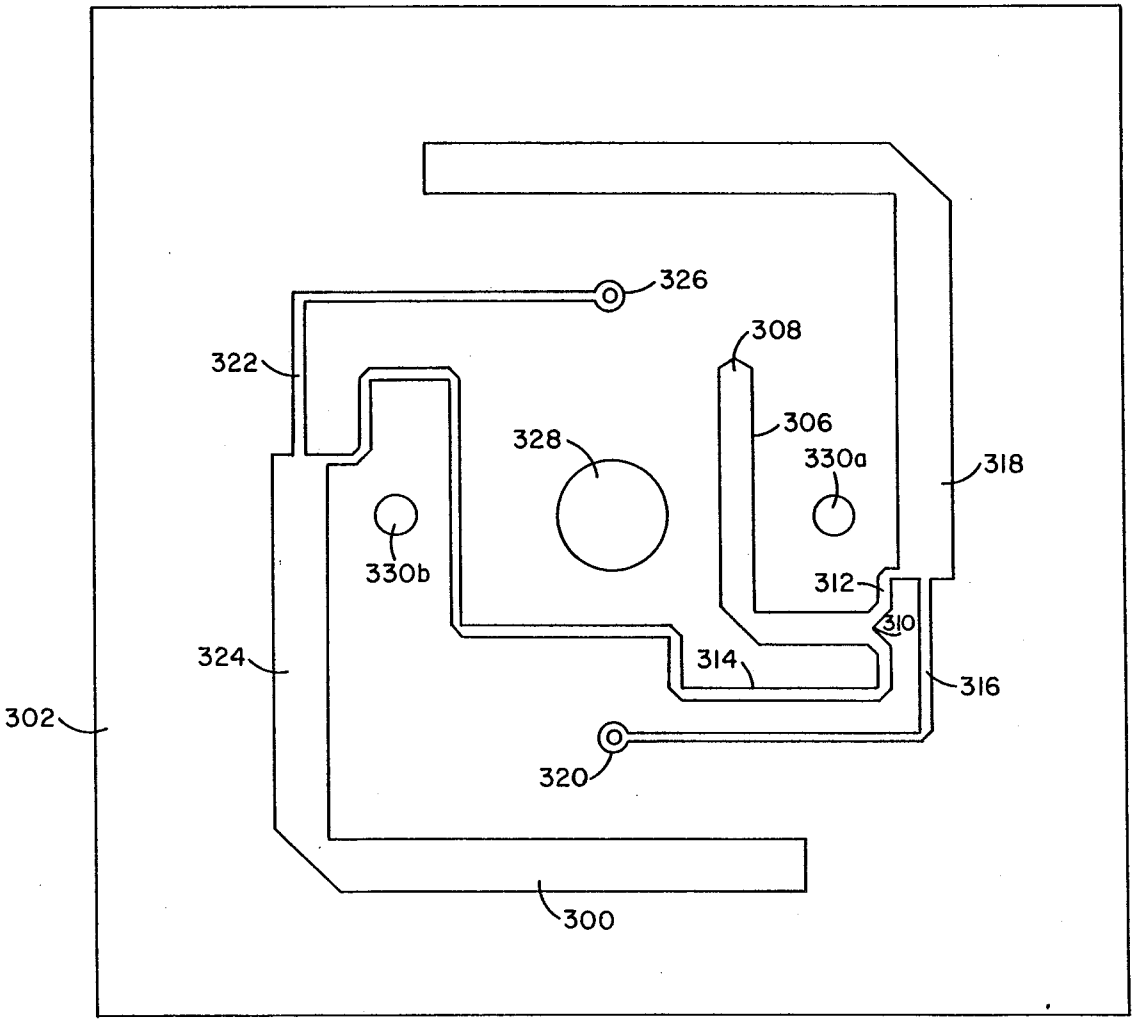
FIG. 8 is a plan view of a microstrip balun/matching circuit of the FIG. 6 embodiment.

Referring to FIG. 8, there is shown in plan view the conductive paths of a microstrip circuit of the type described for use as trace wiring 250 of FIG. 6. The circuit of FIG. 8 is identical in function to that described with reference to FIG. 4, and similar in form to that described with reference of FIG. 5.

FIG. 8 illustrates trace wiring 300, typically copper, on a dielectric substrate 302, which may be dielectric sheet 208 of FIG. 6. Substrate 302 includes apertures 328, 330*a*, and 330*b*, which accommodate the passage through substrate 302 of conductors 214 and 218 from input feed connector 212, probe 222*a* and probe 222*b*, respectively (see FIGS. 6–7).

Trace section 306 includes at one end pad 308 for electrical connection with conductor 256 of input feed connector 254 (see FIG. 6), and at its other end 310 includes a reactive split into trace sections 312 and 314. Trace section 312 terminates in a quarter-wavelength trace section 316 and a half-wavelength trace section 318. Section 316 terminates in pad 320, for electrical connection with one end of probe 260*a* (see FIGS. 6–7). Trace section 314 terminates in a quarter-wavelength trace section 322 and a half-wavelength trace section 324. Section 322 terminates in pad 326, for electrical connection with one end of probe 260*b* (see FIG. 6–7). As seen in FIG. 6, where probes 260*a,b* extend past microstrip circuit trace wiring 206 and through dielectric sheet 204, the assembly comprising elements 204, 206 may be configured as in FIG. 5, having apertures 88*a,b* through which probes 260*a,b* may be passed. In the circuit shown in FIG. 8, the electrical length of trace section 314 exceeds that of trace section 312 by 180 degrees.

The two embodiments of the present invention described in the preceding paragraphs are viable from a theoretical standpoint. Nevertheless, they are not entirely practical from the standpoint of ease of manufacture. As an example, the apparatus thus far disclosed does not lend itself readily to making all of the required electrical connections, typically by soldering, of the vertically-oriented elements, i.e., the probes and the conductors from the input feed connectors.

Figure 9:
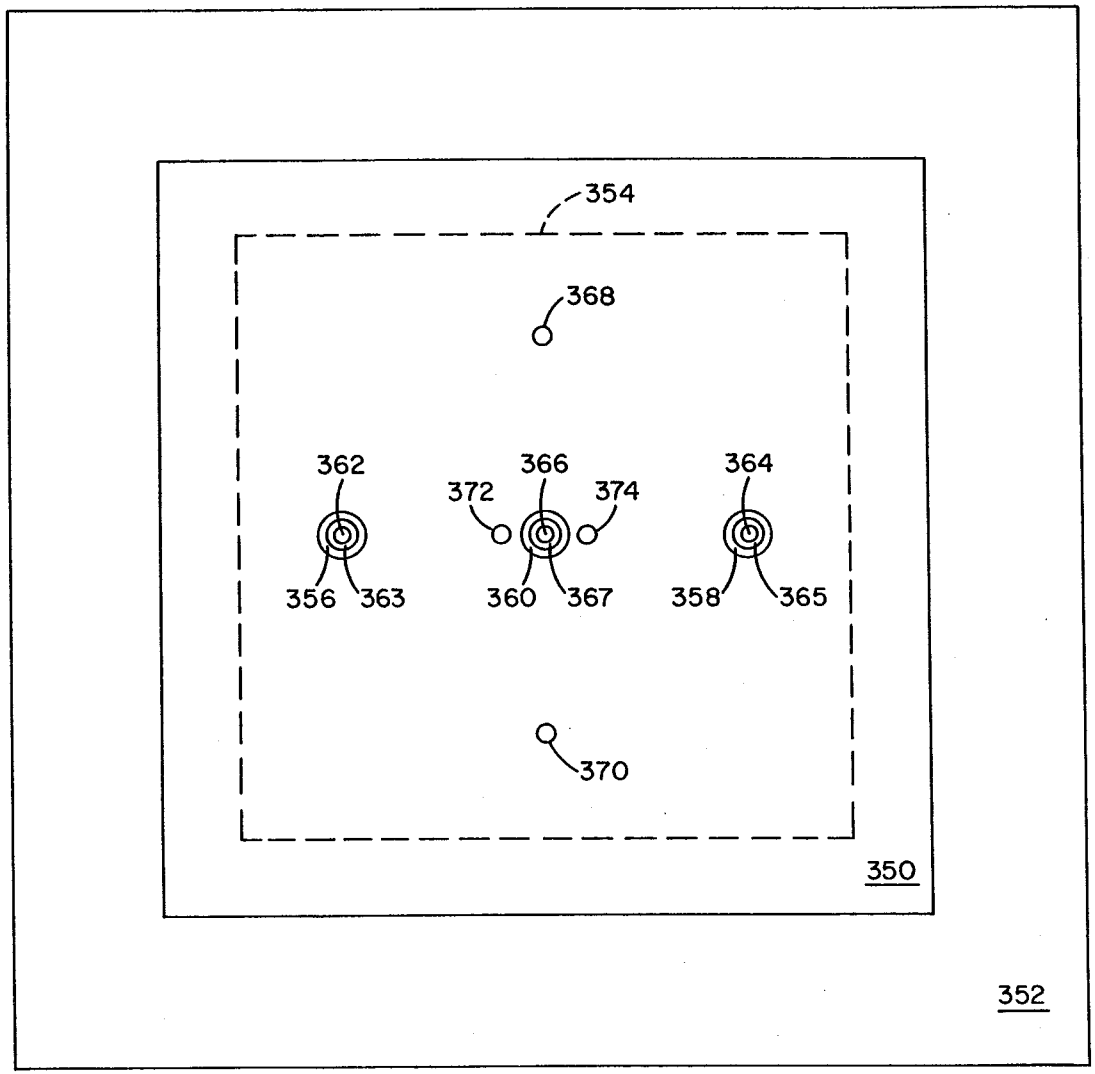
FIG. 9 illustrates an embodiment of a patch element which is preferable for ease of manufacture.

FIG. 9 illustrates a plan view of a patch radiator including a modified patch element 350 which may be used to overcome the difficulties of manufacture of the present invention. Patch element 350 is illustrated for use with the dual-polarization embodiment of FIGS. 6–7, and is therefore also applicable to the single polarization embodiment of FIGS. 2–3.

Patch element 350 comprises a conductive sheet, typically copper, affixed to a dielectric sheet 352. On the underside of dielectric sheet 352 is microstrip circuit trace wiring 354, represented as a dashed outline. Patch element 350 includes generally circular annuli 356, 358 and 360, which are areas where copper plating is removed and which surround smaller apertures 362, 364 and 366, respectively, extending through dielectric sheet 352. Apertures 362, 364 and 366 are typically plated-through holes, including flanged conductive areas 363, 365 and 367 on both surfaces of dielectric sheet 352. Small apertures 368, 370, 372 and 374 extend through patch element 350 and dielectric sheet 352.

In the manufacture of a patch radiator using the apparatus illustrated by FIG. 9, first conductor 214 (see FIG. 7) extends upwardly through aperture 366 in dielectric sheet 352 and annulus 360 in patch element 350. Thus, it is possible to apply melted solder to the top of conductor 214, which solder will flow along the conductive plating through aperture 366 and establish electrical contact between conductor 214 and microstrip circuit trace wiring 354, typically, at pad 92 (see FIG. 5), while annulus 360 maintains electrical isolation between conductor 214 and patch element 350.

The connection between the top of probe 222*b* (see FIG. 7) and trace wiring 354 is effected in a similar manner: melted solder is applied to the top of probe 222*b* extending through aperture 362 in dielectric sheet 352 and annulus 356 in patch element 350. The solder flows along the conductive plating through aperture 362 and establishes electrical contact between probe 222*b* and trace wiring 354, typically, at pad 110 (see FIG. 5), while annulus 356 maintains electrical isolation between probe 222*b* and patch element 350. In like fashion, the connection between the top of probe 222*a* (see FIG. 7) and trace wiring 354 is made by applying melted solder to the top of probe 222*a* extending through aperture 364 in dielectric sheet 352 and annulus 358 in patch element 350. The solder flows along the conductive plating through aperture 364 and establishes electrical contact between probe 222*a* and trace wiring 354, typically, at pad 104 (see FIG. 5), while annulus 358 maintains electrical isolation between probe 222*a* and patch element 350.

The tops of probes 260*a* and 260*b* (see FIG. 6) extend through apertures 368 and 370, respectively, in patch element 350, and soldering provides the electrical and physical connections therebetween. Similarly, second conductors 218*a* and 218*b* from input feed connector 212 (see FIG. 7) extend through apertures 372 and 374, respectively, and soldering provides the electrical contact between conductors 218*a,b* and patch element 350.

Figure 10:
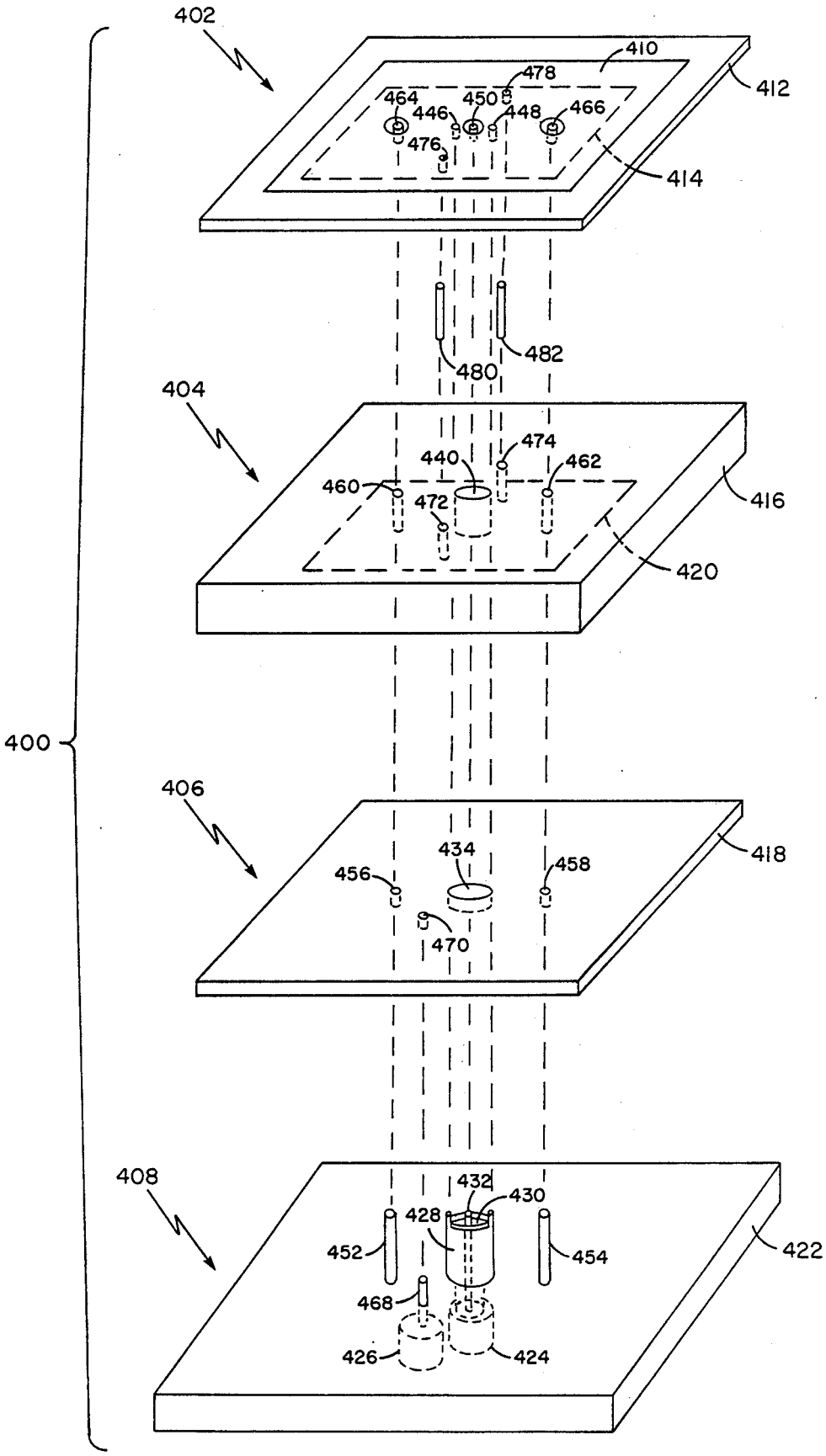
FIG. 10 is an exploded view of the FIG. 6 embodiment suitable for manufacture.

Referring now to FIG. 10, there is shown an exploded view of the four assemblies 402, 404, 406, and 408 which are bonded together to form patch radiator 400. The FIG. 10 embodiment employs a top assembly 402, similar to the apparatus shown in FIG. 9, including patch element 410, thin dielectric sheet 412, and microstrip circuit trace wiring 414 (on the underside of sheet 412), which comprises a double-tuned matching circuit and a balun. Assembly 404 comprises a relatively thick dielectric sheet 416 and a second microstrip circuit trace wiring 420 (on the underside of sheet 416), which also comprises a double-tuned matching circuit and a balun. Assembly 406 comprises a thin dielectric sheet 418. Bottom assembly 408 comprises conductive sheet 422 and input feed connectors 424 and 426. Conductors 428 and 432 coupled to input feed connector 424 are spaced apart by dielectric sleeve 430 and are adapted to extend through aperture 434 of assembly 406, through aperture 440 of assembly 404, and through apertures 446, 448 and 450 of assembly 402. Conductor 468, coupled to input feed connector 426, is positioned to extend through aperture 470 of assembly 406.

Probes 452 and 454, affixed to conductive sheet 422 are adapted to extend through apertures 456 and 458, respectively, of assembly 406, through apertures 460 and 462, respectively, of assembly 404, and through apertures 464 and 466 of top assembly 402. Apertures 472 and 474, in assembly 404, are plated-through holes in sheet 416 and are aligned with apertures 476 and 478, respectively, as shown in assembly 402.

In an illustrative fabrication process, assembly 406 is bonded to assembly 408 by epoxy. Assemblies 402 and 404 are then stacked together. Probes 480 and 482 are passed through apertures 472, 476 and 474, 478, respectively, and soldered at the bottom of assembly 404 to trace wiring 420. This combined assembly is then stacked onto assemblies 406 and 408 with intervening heat-sensitive bonding films (not shown) between all dielectric layers. With the application of heat, the films complete the bonding of the assemblies. A final step would apply solder to the probes and conductors extending through the apertures in assembly 402 as described in relation of FIG. 9.

Figure 11:
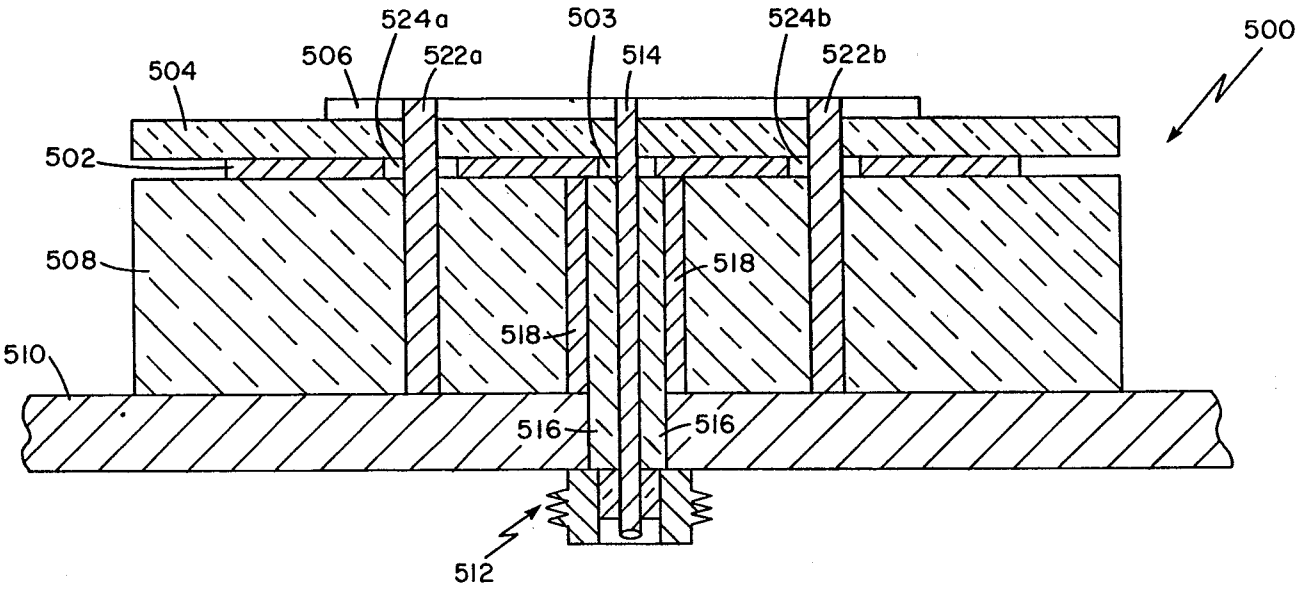
FIG. 11 is a cross-sectional view of a patch radiator according to a third embodiment of the present invention.

A final embodiment of the present invention is shown in cross-sectional view in FIG. 11, which embodiment is a variant of the patch radiator of FIGS. 2–3. Patch radiator 500 of FIG. 11 is a multi-layer structure including patch element 502 attached to one side of dielectric sheet 504, which has microstrip circuit trace wiring 506 etched into its upper surface. Patch element 502 functions as ground plane for the microstrip circuit including trace wiring 506. This assembly is attached to dielectric sheet 508, which has bonded to its bottom surface ground plane conductor 510.

Input feed connector 512 is attached to the underside of ground plane conductor 510; a first conductor 514 of connector 512 passes through conductor 510, dielectric sheet 508, path element 502 (via aperture 503) and dielectric sheet 504, where it makes electrical contact with trace wiring 506. Second conductor 518 of connector 512, which, illustratively, comprises a hollow cylinder, makes electrical contact with conductor 510, passes through dielectric sheet 508, and makes electrical contact with patch element 502 at positions generally symmetrical about the center of patch element 502. Conductor 514 is spaced from conductor 518 by an insulating sleeve 516, typically made of Teflon. It will be seen that conductor 518 may be replaced by a plated-through hole between patch element 502 and a plating on the underside of dielectric sheet 508.

The structure of the FIG. 11 embodiment of patch radiator 500 is completed by conductive probes **522*a* and 522*b* which provide a path for the flow of electrical current between microstrip circuit trace wiring 506 and ground plane conductor 510. Probes 522*a* and 522*b* pass through dielectric sheet 508, patch element 502 (via apertures 524*a* and 524*b*, respectively) and dielectric sheet 504, and are substantially normal to patch element 502 and ground plane conductor 510. Probes 522*a* and 522*b* are substantially equally spaced from the center of patch element 502 and are diametrically positioned with respect to it. The dimensions and materials of the patch radiator 500 of FIG. 11 are substantially the same as corresponding elements of the patch radiator 10 of FIGS. 2–3**.

While the principles of the present invention have been demonstrated with particular regard to the illustrated structure of the figures, it will be recognized that various departures from such illustrative structure may be undertaken in practice of the invention. As an example, it would be considered within the ordinary skill of one knowledgeable in the art to construct an antenna array by assembling a plurality of the patch radiators of a type disclosed herein in any configuration or a common ground plane or substrate. It is furthermore considered to require no greater skill level to fabricate such an array with large sheets of dielectric material having a multiplicity of patch elements and microstrip circuits affixed thereon. The scope of this invention is therefore not intended to be limited to the structure disclosed herein but should instead be gauged by the breadth of the claims which follow.

What is claimed is:

1. In a radiator for use in a phased array antenna, said radiator including an electrically-conductive patch element separated from a ground plane element to form a cavity therebetween, and further including coupling means for receiving an input signal thereto, an apparatus for exciting an electric field in said cavity, said apparatus comprising:

a microstrip circuit including trace wiring positioned intermediate said patch element and said ground plane element, said trace wiring coupled to said coupling means, said patch element functioning as a ground plane for said microstrip circuit; and first and second conductive probes disposed between said trace wiring and said ground plane element for conducting currents in said cavity, said currents providing electromagnetic coupling between said first and second conductive probes and said patch element, said microstrip circuit providing double-tuned impedance matching between said coupling means and said patch element, said microstrip circuit further including a balun coupled to said first and second probes and responsive to an input signal applied at said coupling means for providing balun output signals in phased-apart relationship respectively at said first and second probes.

2. The apparatus according to claim 1 further including a dielectric sheet interposed between said patch element and said microstrip circuit trace wiring.

3. The apparatus according to claim 2 wherein said dielectric sheet comprises a low-loss composite material of relative dielectric constant substantially equal to 2.2.

4. The apparatus according to claim 2 further including a second dielectric sheet interposed between said microstrip circuit trace wiring and said ground plane element, said second dielectric sheet being substantially thicker than said first-mentioned dielectric sheet.

5. The apparatus according to claim 4 wherein said second dielectric sheet comprises a low-loss composite material of relative dielectric constant substantially equal to 2.2.

6. The apparatus according to claim 1 wherein the height of said radiator above said ground plane element is less than 0.1 wavelength of said input signal at a predetermined frequency.

7. The apparatus according to claim 6 wherein said predetermined frequency is in the S-band.

8. The apparatus according to claim 1 wherein said microstrip circuit trace wiring is included within the area directly beneath said patch element.

9. The apparatus according to claim 1 wherein said microstrip circuit includes first and second tuned circuits, each of said tuned circuits comprising a quarter-wavelength matching leg and a half-wavelength matching stub at a predetermined frequency of said input signal.

10. The apparatus according to claim 1 wherein said balun includes two conductive paths which differ in their electrical lengths by an odd multiple of half-wavelengths at a predetermined frequency of said input signal.

11. In a radiator for use in a phased array antenna, said radiator including an electrically-conductive patch element separated from a ground plane element to form a cavity therebetween, and further including coupling means for receiving first and second input signals thereto, an apparatus responsive to said first and second input signals for selectively exciting electric fields of a first or a second polarization in said cavity, said apparatus comprising:

first and second microstrip circuits comprising first and second trace wirings, respectively, positioned intermediate said patch element and said ground plane element, said first and second trace wirings coupled to said coupling means, said patch element functioning as a ground plane for said first microstrip circuit and said ground plane element functioning as a ground plane for said second microstrip circuit;

first and second conductive probes disposed between said first trace wiring and said ground plane element for conducting first currents in said cavity, said first currents providing electromagnetic coupling between said first and second conductive probes and said patch element; and third and fourth conductive probes disposed between said second trace wiring and said patch element for conducting second currents in said cavity, said second currents providing electromagnetic coupling between said third and fourth conductive probes and said ground plane element, said first and second microstrip circuits providing double-tuned impedance matching between said coupling means and said patch element, said first microstrip circuit further including a first balun coupled to said first and second probes and responsive to said first input signal applied at said coupling means for providing first balun output signals in phased-apart relationship respectively at said first and second probes, said second microstrip circuit further including a second balun coupled to said third and fourth probes and responsive to said second input signal applied at said coupling means for providing second balun output signals in phased-apart relationship respectively at said third and fourth probes, said probes being relatively positioned such that the plane including said first and second probes is not parallel with the plane including said third and fourth probes.

12. The apparatus according to claim 11 further including a first dielectric sheet interposed between said patch element and said first trace wiring and a second dielectric sheet interposed between said ground plane element and said second trace wiring.

13. The apparatus according to claim 12 wherein each of said first and second dielectric sheet comprises a low-loss composite material of relative dielectric constant substantially equal to 2.2.

14. The apparatus according to claim 13 further including a third dielectric sheet interposed between said first and second trace wirings, said third dielectric sheet being substantially thicker than said first and second dielectric sheet.

15. The apparatus according to claim 14 wherein said third dielectric sheet comprises a low-loss composite material of relative dielectric constant substantially equal to 2.2.

16. The apparatus according to claim 11 wherein the height of said radiator above said ground plane element is less than 0.1 wavelength of said input signal at a predetermined frequency.

17. The apparatus according to claim 16 wherein said predetermined frequency is in the S-band.

18. The apparatus according to claim 11 wherein said first and second microstrip circuit trace wirings are included within the area directly beneath said patch element.

19. The apparatus according to claim 11 wherein each of said first and second microstrip circuit includes first and second tuned circuits, each of said tuned circuits comprising a quarter-wavelength matching leg and a half-wavelength matching stub at a predetermined frequency of said input signal.

20. The apparatus according to claim 11 wherein each of said first and second baluns includes two conductive paths which differ in their electrical lengths by an odd multiple of half-wavelengths at a predetermined frequency of said input signal.

21. The apparatus according to claim 11 wherein said first, second, third, and fourth probes are relatively positioned such that the plane including said first and second probes is orthogonal with the plane including said third and fourth probes.

* * * * *

UNITED STATES PATENT AND TRADEMARK OFFICE

CERTIFICATE OF CORRECTION

PATENT NO. : 4,924,236

DATED : May 8, 1990

INVENTOR(S) : Jack J. Schuss, et al

It is certified that error appears in the above-identified patent and that said Letters Patent is hereby corrected as shown below:

On the title page, in the title:

" Patch Radiator Element with Microstrip Ballan" should read

--Patch Radiator Element with Microstrip Balun--

Signed and Sealed this

Twenty-first Day of May, 1991

*Attest:*

HARRY F. MANBECK, JR.

*Attesting Officer*

*Commissioner of Patents and Trademarks*